US006390734B1

(12) United States Patent
Marshall

(10) Patent No.: US 6,390,734 B1
(45) Date of Patent: May 21, 2002

(54) METHOD AND APPARATUS FOR ANCHORING A PILING TO A SLAB FOUNDATION

(76) Inventor: Frederick S. Marshall, 1710 Cove Meadow Ct., Arlington, TX (US) 76012

( * ) Notice: Subject to any disclaimer, the term of this patent is extended or adjusted under 35 U.S.C. 154(b) by 0 days.

(21) Appl. No.: 09/754,512

(22) Filed: Jan. 4, 2001

(51) Int. Cl.[7] ..... E02D 35/00

(52) U.S. Cl. ..... 405/230; 405/232; 405/244; 405/249; 52/125.1; 52/169.9; 52/292

(58) Field of Search ..... 405/229, 230, 405/231, 232, 244, 249, 251, 252; 52/125.1, 169.9, 296, 297, 292, 293.1, 293.2, 293.3

(56) References Cited

U.S. PATENT DOCUMENTS

| | | | | | |
|---|---|---|---|---|---|
| 996,397 | A | * | 6/1911 | Breuchaud | 405/231 |
| 1,181,212 | A | * | 5/1916 | Clark | 405/230 |
| 4,070,867 | A | * | 1/1978 | Cassidy | 405/230 |
| 5,154,539 | A | * | 10/1992 | McCown, Sr. et al. | 405/230 |
| 5,234,287 | A | * | 8/1993 | Rippe, Jr. | 405/230 |
| 5,713,701 | A | | 2/1998 | Marshall | 405/232 |
| 5,724,781 | A | * | 3/1998 | Matthias et al. | 52/125.1 |
| 6,047,133 | A | * | 6/2000 | Kelsey | 405/244 |
| 6,200,070 | B1 | * | 3/2001 | Knight | 405/232 |

* cited by examiner

*Primary Examiner*—David Bagnell
*Assistant Examiner*—Frederick L. Lagman
(74) *Attorney, Agent, or Firm*—Bracewell & Patterson, L.L.P.

(57) ABSTRACT

A device and method are provided for leveling and supporting a slab foundation on a column of piling sections. A vertical hole is bored through the slab foundation and an anchoring cylinder is inserted in the hole. An adhesive is used to adhere the outer surface of the anchoring cylinder to a portion of the foundation. The cylinder has a plurality of downward-facing load shoulders which are engaged by upward-facing shoulders of a reacting member positioned across and above the hole. Piling sections are inserted into the anchoring cylinder and forced into the earth with a driving device that reacts against the reacting member. The anchoring cylinder is then supported on the piling sections to maintain the desired level of the foundation.

17 Claims, 4 Drawing Sheets

METHOD AND APPARATUS FOR ANCHORING A PILING TO A SLAB FOUNDATION

BACKGROUND OF THE INVENTION

1. Field of the Invention

The present invention generally relates to the leveling of a foundation and specifically relates to the leveling of a foundation using a column of piling sections located in a central portion of the foundation.

2. Description of the Prior Art

Columns of piling sections are installed under the interiors of buildings using several techniques. Tunnels can be dug under buildings for piling sections to be installed therein, or holes can be cut into the foundations for piling sections to be inserted into the holes from above. The holes must be large enough to permit the passage of piling sections and brackets for fastening the piling sections to the foundations and to provide for working room. To install a six-inch diameter concrete piling through an excavation typically requires a hole measuring 2 feet by 2 feet. When steel piling sections are installed through brackets, the piling sections are cut and welded to the brackets after a foundation is lifted to the desired level.

SUMMARY OF THE INVENTION

A device and method are provided for leveling and supporting a slab foundation on a column of piling sections. A vertical hole is bored through the slab foundation and an anchoring cylinder is inserted in the hole. An adhesive is used to adhere the outer surface of the anchoring cylinder to a portion of the foundation. The cylinder has a plurality of downward-facing load shoulders which are engaged by upward-facing shoulders of a reacting member positioned across and above the hole. Piling sections are inserted into the anchoring cylinder and forced into the earth with a driving device that reacts against the reacting member. The anchoring cylinder is then supported on the piling sections to maintain the desired level of the foundation.

Use of the present invention allows the size of excavations to be greatly reduced. The size of the hole bored in the foundation will be approximately equal to the piling diameter plus 3 inches, reducing the damage caused by interior excavations. Because the assembly for driving a piling section is attached within the anchoring cylinder, no external apparatus is required, reducing the size of the required bore. For steel or concrete piling sections, the present invention allows for piling sections to be adjusted after installation.

Additional objects, features, and advantages will be apparent in the written description that follows.

BRIEF DESCRIPTION OF THE DRAWINGS

The novel features believed to be characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIGS. 3, 4, 6, and 7 are sectional views showing successive steps in the method of installation of.

DETAILED DESCRIPTION OF THE INVENTION

Figure 1:
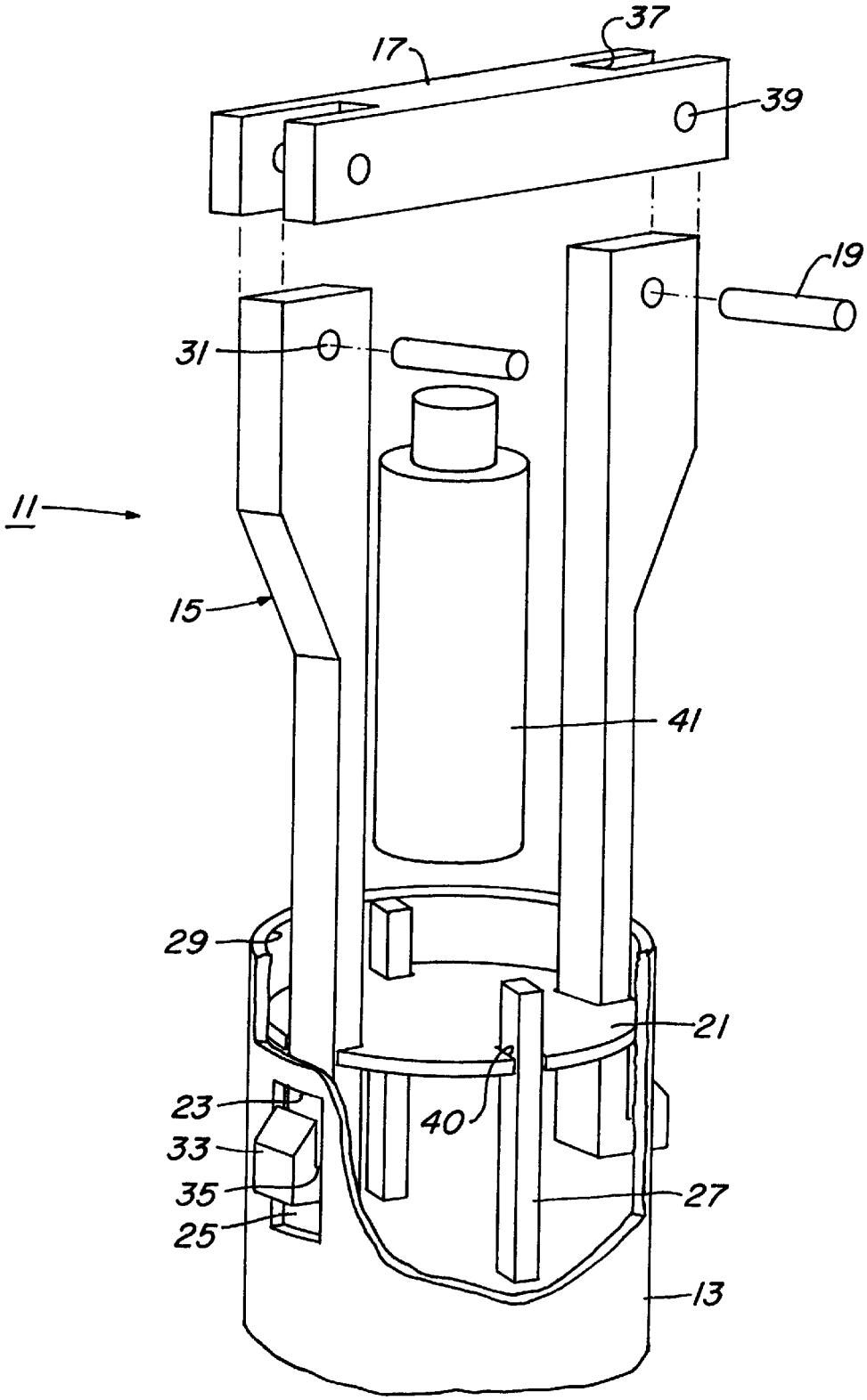
FIG. 1 is a partially-exploded perspective view of a driving assembly of a piling anchor constructed in accordance with this invention.
Figure 2:
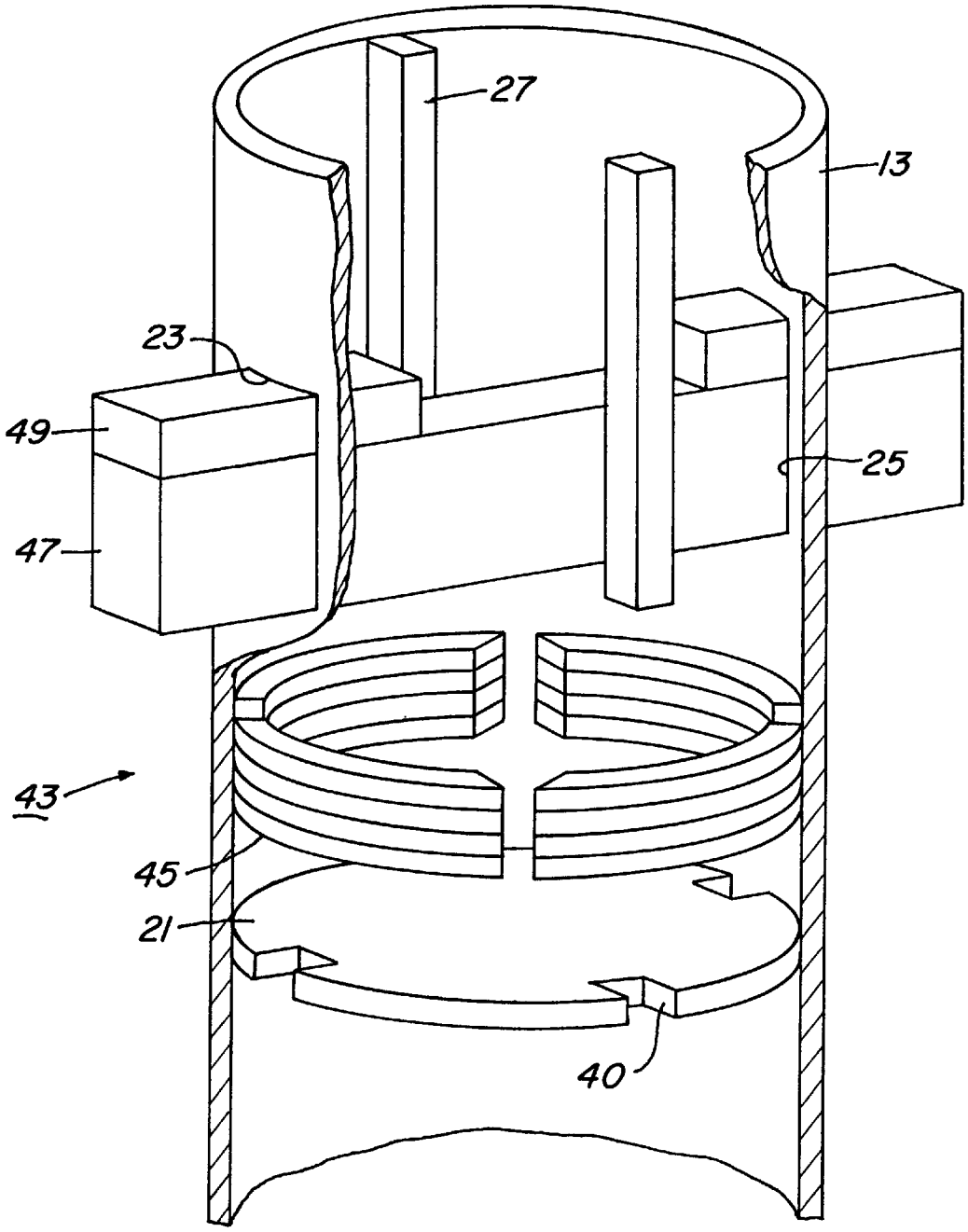
FIG. 2 is a perspective view of a support assembly of a piling anchor constructed in accordance with this invention.

FIGS. 1 and 2 show an apparatus for leveling and supporting a slab foundation on a column of piling sections. The apparatus can be secured to a slab or to the slab and a strengthening beam. The invention comprises two assemblies: a driving assembly, shown in FIG. 1 and used to drive the piling sections and to lift the foundation; and a support assembly, shown in FIG. 2 and used to permanently lock the foundation on the piling after being lifted.

Referring to FIG. 1, the preferred embodiment of the driving assembly 11 comprises an anchoring cylinder 13, two latching bars 15, a reacting bar 17, two connecting pins 19, and a driving plate 21. The anchoring cylinder 13 is a cylindrical tube. Two downward-facing load shoulders 23 are formed as the upper portion of rectangular, opposing hook slots 25 through the sidewall of the anchoring cylinder 13. The hook slots 25 are located near an upper portion of the cylinder 13. The anchoring cylinder 13 has two opposing shim stops 27 that have a rectangular cross-section and are affixed to an upper portion of the inner surface 29 of the anchoring cylinder 13, the longitudinal axes of the shim stops 27 being parallel to the central axis of the anchoring cylinder 13. The lower ends of the shim stops 27 and the lower ends of the hook slots 25 are located the same vertical distance from the top of the anchor cylinder 13.

The latching bars 15 are part of a reacting member that also includes reacting bar 17. Latching bars are formed from metal plates, and each has a hole 31 near an upper end and a hook 33 on a lower portion. The hole 31 is cylindrical and is perpendicular to a plane bisecting both latching bars 15 when the latching bars 15 are in their installed positions. Each hook 33 is a U-shaped member forming an upward-facing load shoulder 35 for engaging the hook slots 25 in the anchoring cylinder 13.

The reacting bar 17 is a rectangular, metal bar having vertical slots 37 in the ends of the bar 17, the bar also having a length sufficient for spanning the distance between the installed latching bars 15. The vertical slots 37 are sized for receiving the upper ends of the latching bars 15 and give the reacting bar 17 an H-shape when viewed from above. Each slot 37 has a horizontal hole 39 having the same diameter and orientation as the holes 31 in the latching bars 15 and which extends through both sides of the slot 37. The length of the connecting pins 19 is equal to the horizontal width of the reacting bar 17, and the outer diameter of the pins 19 is equal to the inner diameter of the holes 31, 39 in the reacting bar 17 and the latching bars 15. The driving plate 21 is a circular metal plate having four notches 40 in its periphery, the notches 40 being sized for receiving the cross-sectional shapes of the latching bars 15 and the shim stops 27. A lifting or driving device 41, which may be a hydraulic ram, can be placed between the reacting bar 17 and the driving plate 21.

FIG. 2 shows the preferred embodiment of the support assembly 43 which comprises the anchoring cylinder 13, steel shims 45, a locking bar 47 and two locking pins 49. The shims 45 are 45 degree arcs and have a radial width equal to the distance that the shim stops 27 protrude into the anchoring cylinder 13. The locking bar 47 is a rectangular metal bar having a length slightly longer than the outer diameter of the anchoring cylinder 13. The horizontal width of the locking bar 47 is equal to the width of the hook slots 25, and the vertical height is equal to ¾ of the height of the hook slots 25. The locking pins 49 are also rectangular metal bars having a width equal to the width of the hook slots 25, but their height is equal to ¼ the height of the hook slots 25. The length of the locking pins 49 can be from ¼ to ⅓ of the outer diameter of the anchoring cylinder 13.

Figure 3:
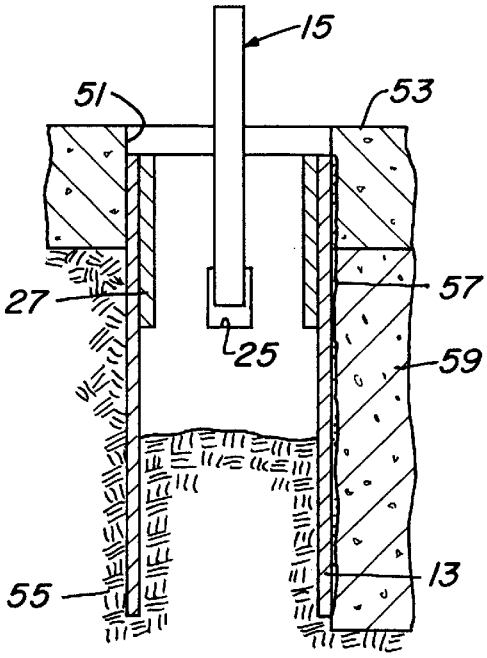
Figure 4:
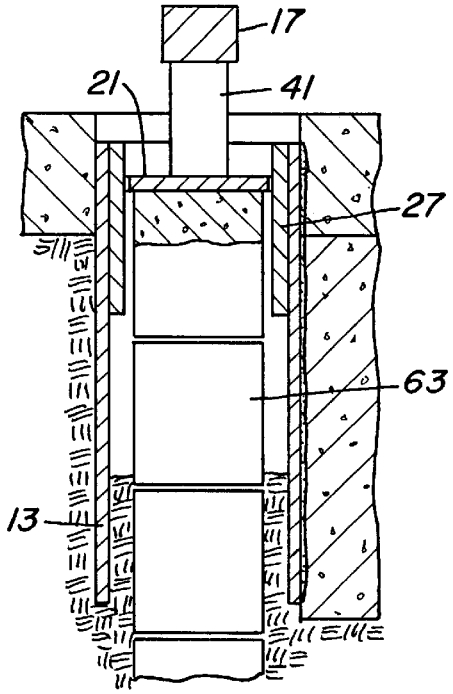
Figure 5:
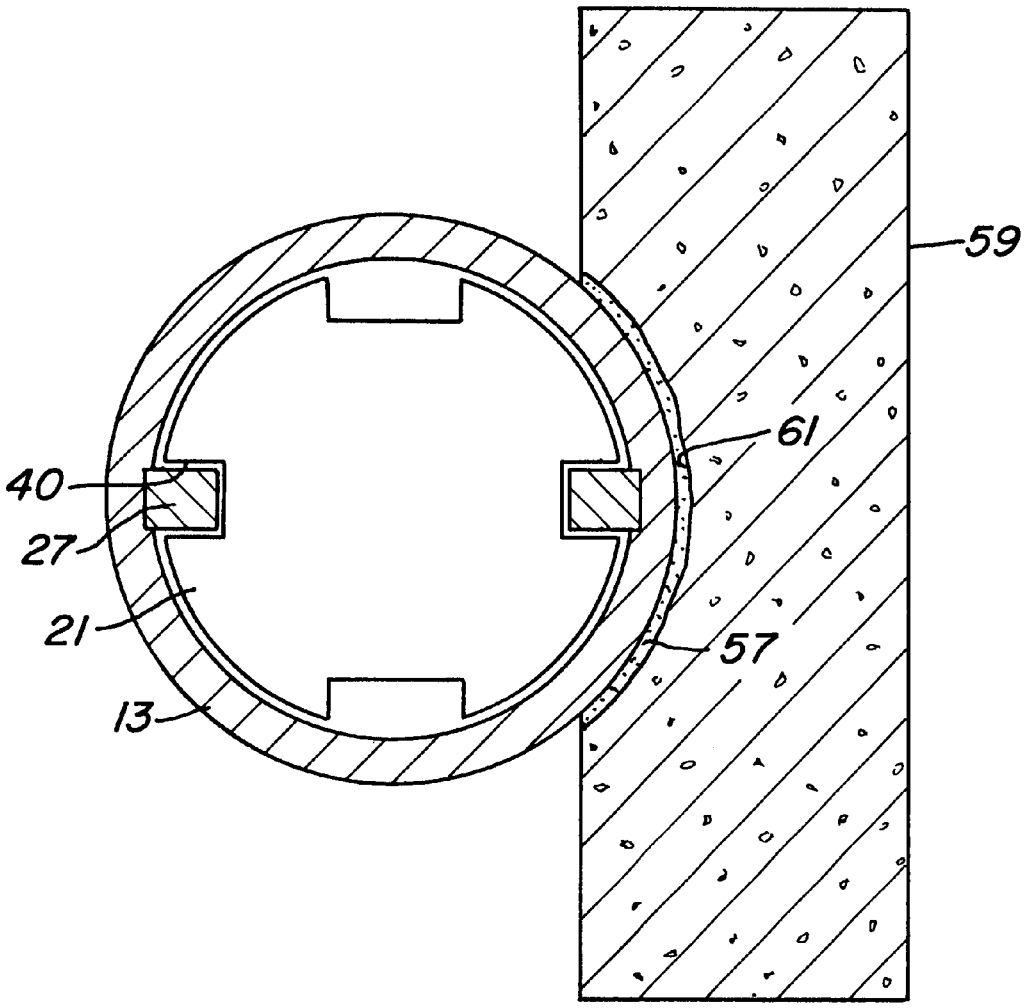
FIG. 5 is a top sectional view showing a piling anchor constructed in accordance with this invention and adhered to a beam of a foundation.

FIGS. 3 through 7 show the steps in the preferred method for installation of the apparatus and the use thereof. Referring to FIG. 3, the anchoring cylinder 13 is installed by boring a hole 51 through the slab 53 of a foundation and into the earth 55 below, cleaning the inner surface of the hole 51, coating the concrete portions of the inner surface of the hole 51 with a layer of adhesive 57, and then inserting the anchoring cylinder 13 into the hole 51. As seen in these figures, it may be necessary or desired to locate the hole 51 so that the hole 51 penetrates through a vertical side of a horizontal strengthening beam 59 of the foundation. As seen in FIG. 5, this encroachment creates in the beam 59 a concave recess 61 preferably having an arc of between 120 and 180 degrees. It is not necessary for all 360 degrees of the hole 51 to penetrate through a beam 59, and it is desirable to avoid placing the hole 51 directly through a beam 59 to avoid cutting cables or reinforcing steel located in the beam 59. After the anchoring cylinder 13 is installed, the hooks 33 on the latching bars 15 are inserted into the hook slots 25 of the anchoring cylinder 13.

Figure 6:
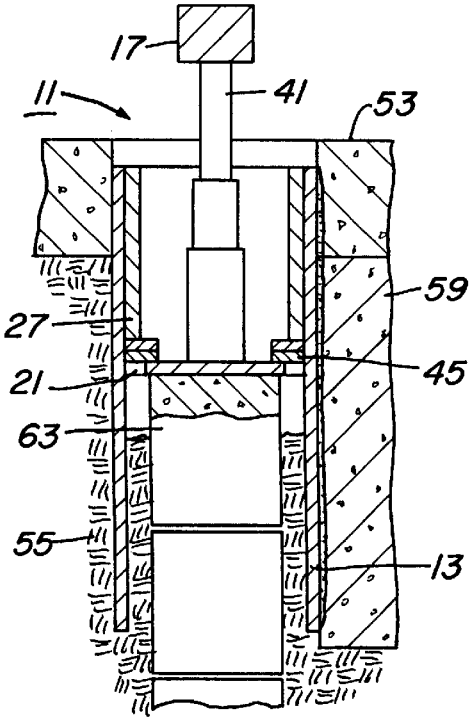

The steps for inserting the column of piling sections 63 are shown in FIGS. 4 and 6. Steel or concrete piling sections 63 are placed within the anchoring cylinder 13 and the driving plate 21 is placed on top of the uppermost piling section 63. FIG. 5 shows the driving plate 21 placed with notches 40 aligned to receive the corresponding shim stops and latching bars. The reacting bar 17 is attached to the latching bars 15 by inserting the upper ends of the bars 15 into the slots 37 of the reacting bar 17 and inserting the connecting pins 19 into the aligned holes 31, 39. The piling sections 63 are cylindrical and have an outer diameter less than the distance between the two latching bars 15. The hydraulic ram 41 is placed between the reacting bar 17 and the driving plate 21.

To install a column of piling sections 63, hydraulic power is supplied to extend the ram 41, as shown in FIG. 6. The ram 41 applies a downward force to the driving plate 21 as the reacting bar 17 opposes the upward reaction force. This upward force is directed into the slab 53 and beam 59 by the driving assembly 11 and tends to lift the foundation. The downward force pushes the piling section 63 into the earth 55. Once the ram 41 is fully extended, the ram 41 is retracted and removed, and the driving plate 21 is then removed. A second piling section 63 is placed in the anchoring cylinder 13, the driving plate 21 is replaced, and the ram 41 is reinserted. The second piling section 63 is then driven into the earth 55, and the process is repeated until the earth 55 below the piling sections 63 is compacted enough to resist further downward movement.

The top of the driving plate 21 must be located below the lower ends of the shim stops 27 to allow shims 45 to be placed between the shim stops 27 and the driving plate 21. To achieve this, it may be necessary to remove the uppermost piling section 63 and replace it with a shorter piling section 63.

After the column of piling sections 63 is installed, the ram 41 is used to lift the foundation to the desired level. With the ram 41 still extended and supporting the foundation at this level, shims 45 are used to fill the space between the lower ends of the shim stops 27 and the top of the driving plate 21.

Figure 7:
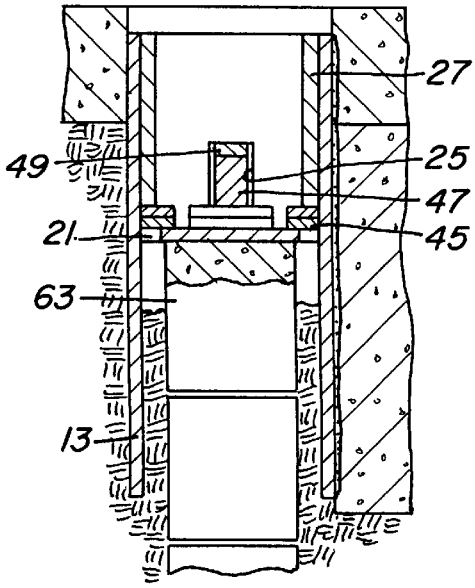

As seen in FIG. 7, the ram 41 is withdrawn and the driving assembly 11 is removed while the anchoring cylinder 13 is being supported by the shim stops 27 resting on the stacks of shims 45. Additional shims 45 are used to fill the space from the top of the driving plate 21 to the bottoms of the hook slots 25. If desired, additional shims 45 of various configurations can be placed near the center of the driving plate 21. The locking bar 47 is then lowered into the anchoring cylinder 13 and the ends of the locking bar 47 are placed into the hook slots 25. The locking pins 49 are placed on top of the locking bar 47 and driven into the hook slots 25 to secure the locking bar 47 in the hook slots 25.

Several advantages are realized from the use of the present invention. The size of excavations are greatly reduced, reducing the damage caused by interior excavations. The assembly for driving the piling sections is attached within the anchoring cylinder, and no external apparatus is required, reducing the size of the required bore. For steel or concrete piling sections, piling sections can be adjusted after installation.

While the invention is shown in only one of its forms, it should be apparent to those skilled in the art that it is not so limited, but is susceptible to various changes without departing from the scope of the invention.

I claim:

1. A method for leveling and supporting a slab foundation on a column of piling sections comprising:

(a) boring a vertical hole through the slab foundation;

(b) inserting an anchoring cylinder in the hole, the cylinder having a plurality of downward-facing load shoulders;

(c) adhering an outer surface of the anchoring cylinder to a portion of the foundation;

(d) engaging upward-facing shoulders of a reacting member with the downward-facing load shoulders of the anchoring cylinder and positioning the reacting member across and above the hole;

(e) inserting piling sections into the hole through the anchoring cylinder and forcing the piling sections into the earth with a driving device that reacts against the reacting member; then (f) supporting the anchoring cylinder on the piling sections.

2. The method of claim 1, wherein:

step (a) comprises encroaching into a vertical side of a strengthening beam of the foundation while boring the hole to create additional concrete surface area for adhering the anchoring cylinder thereon.

3. The method of claim 1, wherein:

step (c) comprises applying an adhesive between the anchoring cylinder and the portion of the foundation.

4. The method of claim 1, wherein step (d) comprises:

providing the reacting member with a plurality of latching bars, each bar having a hook that forms one of the upward-facing shoulders; and inserting the hook of each bar into a hook slot, the hook slots comprising the downward-facing load shoulders of the anchoring cylinder.

5. The method of claim 1, wherein:

step (e) further comprises placing a driving plate on an upper surface of an uppermost piling section for distributing a downward force across the surface.

6. The method of claim 1, wherein:

step (f) further comprises inserting a locking bar under the load shoulders, the locking bar bearing against an uppermost piling section for supporting the anchoring cylinder on the piling sections.

7. A method for leveling and supporting a slab foundation on a column of piling sections, the slab foundation having at least one transverse beam, the method comprising:

(a) boring a vertical hole through the slab foundation and into a portion of the beam, the hole creating a concave recess in the beam;

(b) inserting an anchoring cylinder in the hole, the cylinder having a plurality of downward-facing load shoulders and at least one shim stop;

(c) adhering an outer surface of the anchoring cylinder to the concave recess with an adhesive;

(d) connecting a reacting member to the load shoulders of the anchoring cylinder and positioning the reacting member across and above the hole;

(e) inserting piling sections into the hole and forcing the piling sections into the earth with a driving device that reacts against the reacting member, thereby lifting the foundation to a desired level;

(f) inserting at least one shim between the shim stop and an uppermost piling section; and (g) removing the reacting member and inserting a locking bar under the load shoulders and bearing against the uppermost piling section for supporting the anchoring cylinder on the column of piling sections.

8. The method of claim 7, wherein:

step (e) further comprises placing a driving plate on an upper surface of the uppermost piling section for distributing a downward force across the surface.

9. An apparatus for leveling and supporting a slab foundation on a column of piling sections comprising:

an anchoring cylinder adapted to be inserted into a hole in the slab with an outer surface of the cylinder adhered to the slab;

a plurality of downward-facing load shoulders in the anchoring cylinder; and a reacting member adapted to extend over and above the hole, the reacting member having a plurality of latching bars, each bar having an upward-facing shoulder that engages one of the downward-facing load shoulders, so that a lifting device can be placed between the piling sections and the reacting member to pull the foundation upward relative to the piling sections.

10. The apparatus of claim 9, further comprising:

a plurality of shim stops secured to an inner surface of the anchoring cylinder for receiving shims between the shim stops and the piling sections to enable the latching bars to be removed from the anchoring cylinder.

11. The apparatus of claim 10, further comprising:

a locking bar for supporting the anchoring cylinder on the column of piling sections, the locking bar being inserted under the load shoulders after the shims are installed and the latching bars are removed.

12. The apparatus of claim 9, wherein:

the load shoulders comprise downward-facing surfaces of holes formed in the sidewall of the anchoring cylinder.

13. The apparatus of claim 9, further comprising:

a driving plate that locates within the anchoring cylinder for contact by the lifting device and for distributing a downward force across an upper surface of an uppermost piling section, the driving plate being circular and having a radius less than that of an inner surface of the anchoring cylinder.

14. The apparatus of claim 9, further comprising:

a plurality of shims;

a plurality of shim stops secured to an inner surface of the anchoring cylinder for receiving the shims between the shim stops and the piling sections to enable the latching bars to be removed from the anchoring cylinder; and wherein the shims are arcuate and have an outer radius less than that of the inner surface of the anchoring cylinder.

15. The apparatus of claim 9, wherein:

the upward-facing shoulders of the latching bars comprise outward-protruding hooks.

16. The apparatus of claim 9 wherein:

the reacting member has a cross member that extends between upper ends of the latching bars, the cross member being releasable from the latching bars.

17. The apparatus of claim 9, further comprising:

a plurality of shim stops secured to an inner surface of the anchoring cylinder for receiving shims between the shim stops and the piling sections to enable the latching bars to be removed from the anchoring cylinder; and a driving plate that locates within the anchoring cylinder for contact by the lifting device and for distributing a downward force across an upper surface of an uppermost piling section, the driving plate being circular and having a radius less than that of an inner surface of the anchoring cylinder, the driving plate also having notches in its periphery for receiving the cross-sectional shapes of the latching bars and the shim stops.

* * * * *